US011606976B2

(12) United States Patent
Sanna et al.

(10) Patent No.: US 11,606,976 B2
(45) Date of Patent: Mar. 21, 2023

(54) METHOD AND APPARATUS FOR MANUFACTURING INDUCTIVELY HEATABLE AEROSOL-FORMING RODS

(71) Applicant: PHILIP MORRIS PRODUCTS S.A., Neuchatel (CH)

(72) Inventors: Daniele Sanna, Marin-Epagnier (CH); Christian Agostini, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 386 days.

(21) Appl. No.: 16/603,394

(22) PCT Filed: Jun. 13, 2018

(86) PCT No.: PCT/EP2018/065566

§ 371 (c)(1),
(2) Date: Oct. 7, 2019

(87) PCT Pub. No.: WO2018/229086

PCT Pub. Date: Dec. 20, 2018

(65) Prior Publication Data

US 2020/0107573 A1 Apr. 9, 2020

(30) Foreign Application Priority Data

Jun. 15, 2017 (EP) ..... 17176238

(51) Int. Cl.
*A24F 40/46* (2020.01)
*A24C 5/01* (2020.01)
(Continued)

(52) U.S. Cl.
CPC ..... *A24F 40/46* (2020.01); *A24B 3/14* (2013.01); *A24C 5/01* (2020.01); *A24D 1/20* (2020.01)

(58) Field of Classification Search
None
See application file for complete search history.

(56) References Cited

U.S. PATENT DOCUMENTS 8,215,315 B2 7/2012 Atwell
9,867,394 B2 1/2018 Giannini
(Continued)

FOREIGN PATENT DOCUMENTS

CN 1117829 3/1996
CN 101883502 11/2010
(Continued)

OTHER PUBLICATIONS

PCT Search Report and Written Opinion for PCT/EP2018/065567 dated Aug. 9, 2018 (9 pages).
(Continued)

*Primary Examiner* — Michael J Felton
*Assistant Examiner* — Katherine A Will
(74) *Attorney, Agent, or Firm* — Mueting Raasch Group

(57) ABSTRACT

The present invention relates to a method for manufacturing inductively heatable aerosol-forming rods (100). The method comprises the steps of supplying a continuous susceptor profile (20) to a continuous rod-forming process such as to enter and pass the rod-forming process along a center axis (80) of the rod-forming process, supplying a continuous substrate web (30) comprising an aerosol-forming substrate to the continuous rod-forming process such as to enter the rod-forming process laterally to the susceptor profile and passing the substrate web and the susceptor profile through the rod-forming process, thereby gathering the substrate web into a rod shape around the susceptor profile substantially coaxially to the center axis. The invention further relates to an apparatus (1) for manufacturing inductively heatable aerosol-forming rods (100). The appa-
(Continued)

Figure 1:
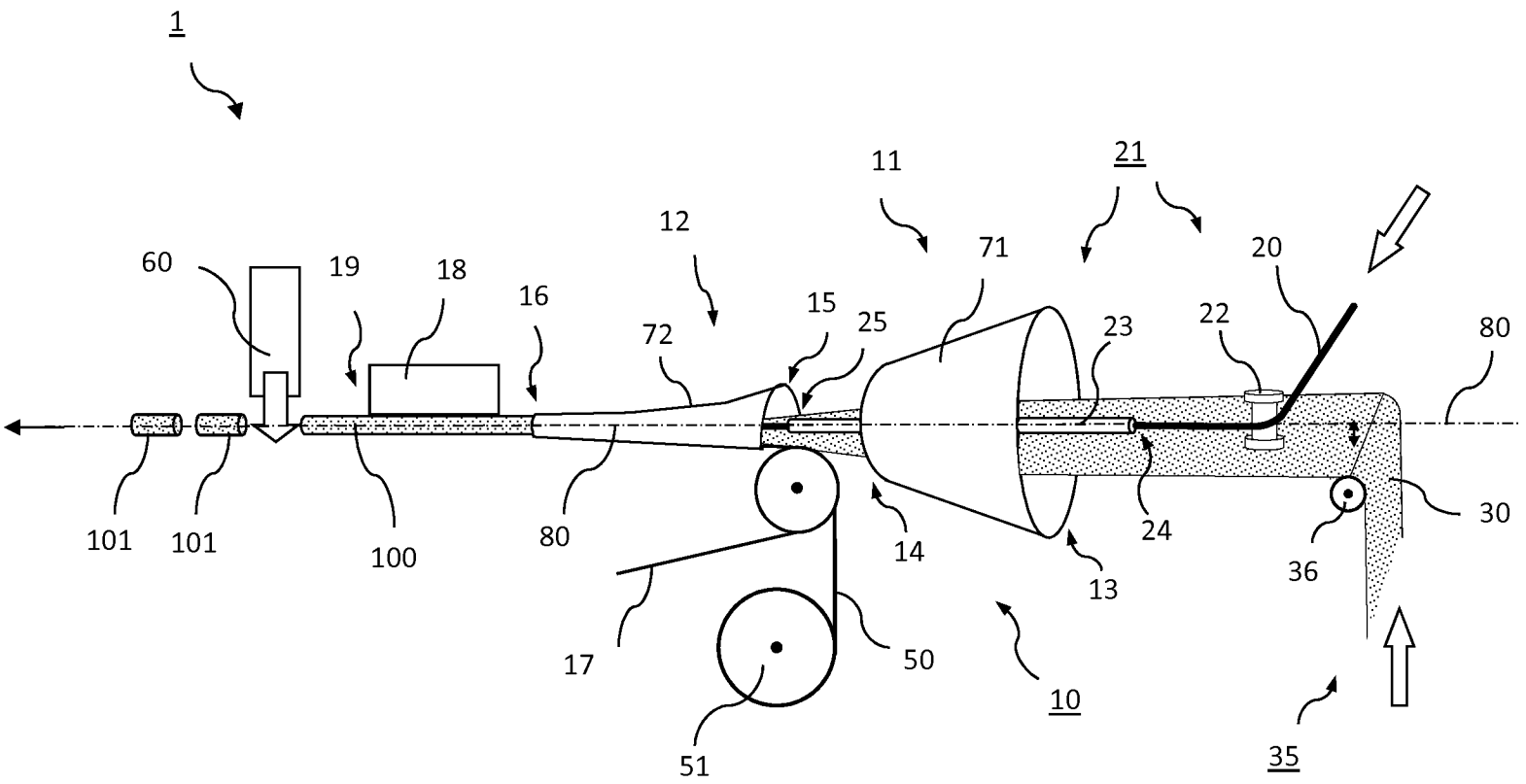

ratus comprises a rod-forming device (10) configured for gathering a continuous substrate web (30) comprising an aerosol-forming substrate into a rod shape around a continuous susceptor profile (20) coaxially to a center axis (80) of the rod-forming device as the substrate web and the susceptor profile pass through the rod-forming device. The apparatus further comprises a susceptor supply (21) configured for supplying the susceptor profile to the rod-forming device such as to enter and pass the rod-forming device along the center axis of the rod-forming device. The apparatus also comprises a substrate supply (35) configured for supplying the substrate web to the rod-forming device such as to enter the rod-forming device laterally to the susceptor profile.

18 Claims, 2 Drawing Sheets

(51) Int. Cl.
*A24B 3/14* (2006.01)
*A24D 1/20* (2020.01)

(56) References Cited

U.S. PATENT DOCUMENTS

2009/0272389 A1* 11/2009 Atwell ..... A24C 5/1821 131/59
2015/0107611 A1 4/2015 Metrangolo
2015/0181938 A1 7/2015 Metrangolo
2015/0272219 A1* 10/2015 Hatrick ..... A24F 40/465 131/328

FOREIGN PATENT DOCUMENTS

| | | |
|---|---|---|
| CN | 103610230 | 3/2014 |
| GB | 2260887 | 5/1993 |
| JP | 2015-509374 | 3/2015 |
| RU | 2660005 | 7/2018 |
| WO | WO 95/27411 | 10/1995 |
| WO | WO 2013/178768 | 12/2013 |
| WO | WO 2015/082652 | 6/2015 |
| WO | WO 2015/177252 | 11/2015 |
| WO | WO 2015/177294 | 11/2015 |
| WO | WO 2016/184928 | 11/2016 |
| WO | WO 2016/184929 | 11/2016 |
| WO | WO 2017/068091 | 4/2017 |

OTHER PUBLICATIONS

Office Action issued in China for Application No. 201880025523.8 dated Aug. 26, 2021 (20 pages). English translation included.
Office Action issued in Russia for Application No. 2019132050/12 dated Nov. 23, 2021 (4 pages). English translation included.
Office Action issued in Japan for Application No. 2019-554664 dated Jul. 19, 2022 (9 pages). English translation included.

* cited by examiner

METHOD AND APPARATUS FOR MANUFACTURING INDUCTIVELY HEATABLE AEROSOL-FORMING RODS

This application is a U.S. National Stage Application of International Application No. PCT/EP2018/065566 filed Jun. 13, 2018, which was published in English on Dec. 20, 2018 as International Publication No. WO 2018/229086 A1. International Application No. PCT/EP2018/065566 claims priority to European Application No. 17176238.8 filed Jun. 15, 2017.

The present invention relates to a method and an apparatus for manufacturing inductively heatable aerosol-forming rods for use in an aerosol-generating system.

Aerosol-generating systems based on inductively heating an aerosol-forming substrate are generally known from prior art. These systems comprise an induction source for generating an alternating electromagnetic field which induces at least one of heat generating eddy currents or hysteresis losses in a susceptor. The susceptor in turn is in thermal proximity of an aerosol-forming substrate which is capable to form an inhalable aerosol upon heating. In particular, the susceptor may be an integral part of a rod-shaped aerosol-forming article. The article comprises the aerosol-forming substrate to be heated and is configured for interaction with an aerosol-generating device comprising the induction source. However, positioning of the susceptor within the substrate of the aerosol-forming rod requires special care as an accurate positioning is crucial for an adequate heating of the substrate and thus for an adequate aerosol formation.

Therefore, it would be desirable to have a reliable method and apparatus for manufacturing inductively heatable aerosol-forming rods including an accurately positioned susceptor.

According to the invention there is provided a method for manufacturing inductively heatable aerosol-forming rods. The method comprises the step of supplying a continuous profile of a susceptor to a continuous rod-forming process such that the susceptor profile enters and passes the rod-forming process along a center axis of the rod-forming process. The method further comprises the step of supplying a continuous substrate web comprising an aerosol-forming substrate to the continuous rod-forming process such that the substrate web enters the rod-forming process laterally to the susceptor profile. The method further comprises the step of passing the substrate web and the susceptor profile through the rod-forming process. Thereby, the substrate web is gathered into a rod shape around the susceptor profile coaxially to the center axis of the rod-forming axis.

Supplying the susceptor profile to the continuous rod-forming process such as to enter and pass the rod-forming process along a center axis of the rod-forming process advantageously causes the susceptor to be accurately pre-positioned at its desired final position within the aerosol-generating rod, that is, coaxially to or on-axis with the center axis of the aerosol-generating rod. In particular, the susceptor profile is pre-positioned along the center axis upstream of the continuous rod-forming process. Preferably, the susceptor profile is pre-positioned along the center axis upstream of or prior to getting into contact with the substrate web. In particular, the susceptor profile enters the rod-forming process at an upstream end of the rod-forming process long a center axis of the rod-forming process. Due to the pre-positioning on the center axis, the susceptor profile defines a physical center for the rod-forming process that the substrate web is coaxially gathered around. Accordingly, the center axis of the rod-forming process preferably defines a center axis of the final aerosol-generating rod resulting from the rod-forming process. Advantageously, this causes the rod-forming process to be reliable and reproducible with regard to an accurate center position of the susceptor within the surrounding substrate. An accurate on-axis position of the susceptor is particularly preferred with regard to a homogeneous, in particular symmetric and reproducible heat distribution in the aerosol-generating rod. Thus, heat generated in the central portion of the rod may symmetrically dissipate into the circumferential periphery of the susceptor profile such as to homogeneously heat-up the aerosol-forming substrate gathered around.

While the susceptor profile enters the rod-forming process on-axis, the substrate web is supplied such as to enter the rod-forming process laterally to the susceptor profile. As used herein, the term 'enter the rod-forming process laterally to the susceptor profile' may include 'enter the rod-forming process alongside the susceptor profile', in particular 'enter the rod-forming process alongside the susceptor profile at an angle between zero degrees and 50 degrees, in particular between zero degrees and 30 degrees, preferably between zero degrees and 20 degrees to the center axis'. Accordingly, the substrate web does not enter the rod-forming process on-axis, but off-axis with regard to the center axis. According to a particular example, the substrate web may enter the rod-forming process from a side towards the susceptor profile, that is, at an angle greater than zero degrees to the center axis. Alternatively, the substrate web may enter the rod-forming process parallel to the susceptor profile, that is, at an angle of zero degrees to the center axis.

In any case, having the substrate web entering the rod-forming process laterally to the susceptor profile advantageously allows for an undisturbed positioning of the susceptor profile prior to surrounding the susceptor profile with the aerosol-forming substrate. Advantageously, this prevents the susceptor from being displaced from the center axis and ensures that there is little or essentially no divergence of the susceptor from its pre-defined position upon entering the rod-forming process. In addition, having the aerosol-forming substrate entering the rod-forming process laterally to the susceptor profile is also favorable to facilitate gathering the substrate web coaxially around the susceptor.

According to the present invention it has been particularly recognized that supplying the susceptor profile on-axis to the rod forming process and supplying the substrate web laterally thereto is preferred over inserting a continuous susceptor profile from the side to a continuous, in particular partially gathered substrate web.

The substrate web may be supplied to the rod-forming process on either side of the susceptor profile. Preferably, the substrate web is arranged below the susceptor profile when entering the rod-forming process. In particular, the substrate web may be arranged substantially horizontal prior to being gathered or partially gathered. Accordingly, the substrate web, that is, a large or flat side of the substrate web, is substantially co-planar to a horizontal plane. Advantageously, having the substrate web arranged below the susceptor profile enables the substrate web to support the susceptor profile as both pass through the rod-forming process. This in turn facilitates to keep a stable position of the susceptor profile along the center axis.

The center axis of the rod-forming process preferably is a straight axis. Alternatively, at least a section of the center axis may be curved.

As used herein, the term 'continuous susceptor profile' either refers to an endless susceptor profile or a to a susceptor profile of a minimum length, for example of at least 1 meter, in particular of at least 2 meters, preferably, of at least 5 meters.

Preferably, the method according to the invention may be performed by using an apparatus for manufacturing inductively heatable aerosol-forming rods according to the invention and as described herein.

As used herein, the term 'susceptor' refers to an element comprising a material that is capable of being inductively heated within an alternating electromagnetic field. This may be the result of at least one of hysteresis losses or eddy currents induced in the susceptor, depending on the electrical and magnetic properties of the susceptor material. Hysteresis losses occur in ferromagnetic or ferrimagnetic susceptors due to magnetic domains within the material being switched under the influence of an alternating electromagnetic field. Eddy currents may be induced if the susceptor is electrically conductive. In case of an electrically conductive ferromagnetic susceptor or an electrically conductive ferrimagnetic susceptor, heat can be generated due to both, eddy currents and hysteresis losses.

The susceptor profile may be formed from any material that can be inductively heated to a temperature sufficient to generate an aerosol from the aerosol-forming substrate. Preferred susceptor profiles comprise a metal or carbon. A preferred susceptor profile may comprise or consist of a ferromagnetic material, for example a ferromagnetic alloy, ferritic iron, or a ferromagnetic steel or stainless steel. Another suitable susceptor profile may be, or comprise, aluminum. Preferred susceptor profiles may be heated to a temperature in excess of 250 degrees Celsius. The susceptor profile may also comprise a non-metallic core with a metal layer disposed on the non-metallic core, for example metallic tracks formed on a surface of a ceramic core. According to another example, the susceptor profile may have a protective external layer, for example a protective ceramic layer or protective glass layer encapsulating the susceptor profile. The susceptor may comprise a protective coating formed by a glass, a ceramic, or an inert metal, formed over a core of susceptor material.

The susceptor profile may be a multi-material susceptor. In particular, the susceptor profile may comprise a first susceptor material and a second susceptor material. The first susceptor material preferably is optimized with regard to heat loss and thus heating efficiency. For example, the first susceptor material may be aluminum, or a ferrous material such as a stainless steel. In contrast, the second susceptor material preferably is used as temperature marker. For this, the second susceptor material is chosen such as to have a Curie temperature corresponding to a predefined heating temperature of the susceptor assembly. At its Curie temperature, the magnetic properties of the second susceptor change from ferromagnetic to paramagnetic, accompanied by a temporary change of its electrical resistance. Thus, by monitoring a corresponding change of the electrical current absorbed by the induction source it can be detected when the second susceptor material has reached its Curie temperature and, thus, when the predefined heating temperature has been reached. The second susceptor material preferably has a Curie temperature that is below the ignition point of the aerosol-forming substrate, that is, preferably lower than 500 degrees Celsius. Suitable materials for the second susceptor material may include nickel and certain nickel alloys.

The susceptor profile may be a filament, a rod, or a sheet, in particular a band. The susceptor profile may have a constant cross-section. The susceptor profile may have an oval or elliptical or circular or square or rectangular or triangular or polygonal cross-section, like, for example a cross-section that has the form of the roman letters "T", "X", "U", "C" or "I" (with or without serif). In case of a circular cross-section, the susceptor profile preferably has a width or diameter of between about 1 millimeter and about 5 millimeter. If the susceptor profile has the form of a sheet or band, the sheet or band preferably has a rectangular shape. In this case, the susceptor profile preferably has a width dimension that is greater than a thickness dimension, for example greater than twice a thickness dimension. Advantageously, a sheet-like susceptor profile has a width preferably between about 2 millimeter and about 8 millimeter, more preferably, between about 3 millimeter and about 5 millimeter, and a thickness preferably between about 0.03 millimeter and about 0.15 millimeter, more preferably between about 0.05 millimeter and about 0.09 millimeter.

As used herein, the term 'aerosol-forming substrate' denotes a substrate formed from or comprising an aerosol-forming material that is capable of releasing volatile compounds upon heating for generating an aerosol. The aerosol-forming substrate is intended to be heated rather than combusted in order to release the aerosol-forming volatile compounds. Preferably, the aerosol-forming substrate is an aerosol-forming tobacco substrate, that is, a tobacco containing substrate. The aerosol-forming substrate may contain volatile tobacco flavor compounds, which are released from the substrate upon heating. The aerosol-forming substrate may comprise or consist of blended tobacco cut filler or may comprise homogenized tobacco material. Homogenized tobacco material may be formed by agglomerating particulate tobacco. The aerosol-forming substrate may additionally comprise a non-tobacco material, for example homogenized plant-based material other than tobacco.

Preferably, the aerosol-forming substrate may comprise a tobacco web, preferably a crimped web. The tobacco web may comprise tobacco material, fiber particles, a binder material and an aerosol former. Preferably, the tobacco sheet is cast leaf. Cast leaf is a form of reconstituted tobacco that is formed from a slurry including tobacco particles, fiber particles, aerosol former, binder and for example also flavors. Tobacco particles may be of the form of a tobacco dust having particles in the order of 30 micrometers to 250 micrometers, preferably in the order of 30 micrometers to 80 micrometers or 100 micrometers to 250 micrometers, depending on the desired sheet thickness and casting gap. The casting gap influences the thickness of the sheet. Fiber particles may include tobacco stem materials, stalks or other tobacco plant material, and other cellulose-based fibers such as for example wood fibers, preferably wood fibers. Fiber particles may be selected based on the desire to produce a sufficient tensile strength for the cast leaf versus a low inclusion rate, for example, an inclusion rate between approximately 2 percent to 15 percent. Alternatively, fibers, such as vegetable fibers, may be used either with the above fiber particles or in the alternative, including hemp and bamboo. Aerosol formers included in the slurry forming the cast leaf or used in other aerosol-forming tobacco substrates may be chosen based on one or more characteristics. Functionally, the aerosol former provides a mechanism that allows it to be volatilized and convey nicotine or flavoring or both in an aerosol when heated above the specific volatilization temperature of the aerosol former. Different aerosol formers typically vaporize at different temperatures. The aerosol-former may be any suitable known compound or mixture of compounds that, in use, facilitates formation of a stable aerosol. A stable aerosol is substantially resistant to thermal degradation at the operating temperature for heating the aerosol-forming substrate. An aerosol former may be chosen based on its ability, for example, to remain stable at or around room temperature but able to volatize at a higher temperature, for example, between 40 degree Celsius and 450 degree Celsius.

The aerosol former may also have humectant type properties that help maintain a desirable level of moisture in an aerosol-forming substrate when the substrate is composed of a tobacco-based product, particularly including tobacco particles. In particular, some aerosol formers are hygroscopic material that functions as a humectant, that is, a material that helps keep a tobacco substrate containing the humectant moist.

One or more aerosol formers may be combined to take advantage of one or more properties of the combined aerosol formers. For example, triacetin may be combined with glycerin and water to take advantage of the triacetin's ability to convey active components and the humectant properties of the glycerin.

Aerosol formers may be selected from the polyols, glycol ethers, polyol ester, esters, and fatty acids and may comprise one or more of the following compounds: glycerin, erythritol, 1,3-butylene glycol, tetraethylene glycol, triethylene glycol, triethyl citrate, propylene carbonate, ethyl laurate, triacetin, meso-Erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

The aerosol-forming substrate may comprise other additives and ingredients, such as flavourants. The aerosol-forming substrate preferably comprises nicotine and at least one aerosol-former. The susceptor being in thermal proximity of or in thermal or physical contact with the aerosol-forming substrate allows for an efficient heating.

A crimped tobacco sheet according to the invention, for example cast leaf, may have a thickness in a range of between about 0.05 millimeter and about 0.5 millimeter, preferably between about 0.08 millimeter and about 0.2 millimeter, and most preferably between about 0.1 millimeter and about 0.15 millimeters.

Preferably, the inductively heatable tobacco rod has a circular or elliptical or oval cross-section. However, the tobacco rod may also have a square or rectangular or triangular or polygonal cross-section.

Preferably, the susceptor profile is dimensionally stable. For this, the shape and material of the susceptor profile may be chosen such as to ensure sufficient dimensional stability. Advantageously, this assures that the originally desired heating susceptor profile is preserved throughout the rod-forming process which in turn reduces the variability of the product performance. Accordingly, the step of gathering the substrate web around the susceptor profile is performed such that the susceptor profile substantially remains undeformed after passing through the rod-forming process. This means, that preferably, any deformation of the susceptor profile remains elastic such that the susceptor profile returns to its intended shape when a deforming force is removed.

Advantageously, the susceptor profile is longitudinally guided, in particular at least along a section of the continuous rod-forming process. Accordingly, the susceptor profile may be longitudinally guided at least along 25 percent, in particular at least along 50 percent, preferably at least along 75 percent, more preferably at least along 90 percent or along 100 percent of a length of the continuous rod-forming process. The length of the continuous rod-forming process corresponds to a path length of a process path through the continuous rod-forming process. Preferably, the susceptor profile is longitudinally guided downstream from an upstream end of the rod-forming process. Likewise, the susceptor profile preferably is longitudinally guided at least along an upstream section of the continuous rod-forming process. Therefore, the step of passing the susceptor profile through the rod-forming process comprises longitudinally guiding the susceptor profile at least along an upstream section of the rod-forming process. Advantageously, longitudinally guiding at least along a section of the continuous rod-forming process prevents the susceptor profile from being displaced from the center axis prior to being sufficiently embedded in the surrounding aerosol-forming substrate. In addition, this is also favorable in view of keeping the susceptor profile dimensionally stable upon passing through the rod-forming process.

The susceptor profile may be also longitudinally guided upstream of the rod-forming process. Longitudinally guiding upstream of the rod-forming process ensures that there is little or essentially no divergence of the susceptor from its pre-defined position upon entering the rod-forming process.

Guiding of the susceptor profile may be accomplished by providing a longitudinal guide, for example a tubular guide. Preferably, the susceptor profile is unguided at a downstream end of the upstream section or further downstream of the upstream section of the rod-forming process.

The longitudinal guide may comprise a guiding profile, in particular a longitudinal guiding profile for longitudinally guiding the susceptor profile. A cross-section of the guiding profile, for example an inner cross-sectional profile of a tubular guide, preferably corresponds to a cross-section, that is, to an outer cross-section of the susceptor profile. Accordingly, the cross-section of a guiding profile of the longitudinal guide may be oval, elliptical, circular, square, rectangular, triangular, or polygonal. Advantageously, having corresponding cross-sections facilitates to maintain the position of the susceptor profile, in particular the rotational position of the susceptor profile. Thus, the longitudinal guide may particularly serve as rotation lock protecting the susceptor profile against twisting or torsion.

As used herein, the term 'upstream section of the continuous rod-forming process' refers to a first stage of the rod-forming process in which the substrate web is at least partially gathered or even fully gathered around the susceptor profile but has not yet achieved the final rod shape. In particular, upon passing the upstream section or the first stage of the continuous rod-forming process, the substrate web is at least partially gathered in a loose arrangement. In this context, "loose" indicates that the substrate web has, at that point, not yet been gathered into the final, more condensed form. The at least partially gathered substrate web may be of any form or shape, in particular of a rod shape, however with a lower density (or larger diameter) than in the final rod shape after having entirely passed the rod-forming process. Preferably, upon passing the upstream section or the first stage of the continuous rod-forming process, the substrate web is gathered at least as much as to at least partially surround the susceptor profile. Thus, the partially surrounding substrate material advantageously provides a supporting embedding of the susceptor for preserving the pre-defined position of the susceptor profile.

The rod-forming process may further comprise a second stage or a downstream section for completing the step of gathering the substrate web coaxially around the susceptor profile into the final rod shape. Accordingly, the susceptor profile may also be longitudinally guided at least partially along a second stage or a downstream section of the continuous rod-forming process.

In general, the method may comprise the step of partially gathering the substrate web in a transverse direction with respect to a transport direction of the substrate web prior to gathering the substrate web into a rod shape around the susceptor profile. As used herein, the term 'transport direction of the substrate web' refers to the respective transport direction of the substrate web when being supplied to the rod-forming process or when being passed through the rod-forming process. As described above, partially gathering the substrate web may be performed by passing the substrate web through an upstream section or a first stage of the continuous rod-forming process. Alternatively or additionally, partially gathering the substrate web may be performed upstream of the actual rod-forming process. Preferably, the susceptor profile is already pre-positioned along the center axis upstream of any gathering of the substrate web.

According to a further aspect of the method, the method may comprise the step of crimping the substrate web prior to supplying it to the continuous rod-forming process. In particular, the substrate web may be crimped longitudinally. That is, the substrate web may be provided with a longitudinal folding structure along a longitudinal axis of the continuous sheet, that is, along a transport direction of the substrate web. Preferably, the longitudinal folding structure provides the substrate with a zigzag or wave-like cross section. Advantageously, crimping the substrate web facilitates the step of gathering the substrate web in a transverse direction with respect to its longitudinal axis into the final rod shape. In particular, the longitudinal folding structure supports proper folding of the aerosol-forming substrate around the susceptor. This proves advantageous for manufacturing aerosol-forming rods with reproducible specifications.

Preferably, the continuous susceptor profile is a continuous susceptor sheet. The continuous susceptor sheet may be provided on a bobbin. As used herein, the term 'continuous susceptor sheet' refers to a continuous susceptor profile having an oblong or flat cross-section, in particular a rectangular cross-section. That is, the continuous susceptor sheet has a cross-sectional width extension larger than a cross-sectional thickness extension. Preferably, a width extension is 10 to 250, in particular 50 to 150, preferably 60 to 120 times larger than a thickness extension. For example, the continuous susceptor sheet may have a width extension between 2 millimeters and 6 millimeters, in particular between 3 millimeters and 5 millimeters, and a thickness extension between 20 micrometers and 70 micrometers, in particular between 25 micrometers and 60 micrometers.

Preferably, a width extension of the susceptor sheet corresponds to a width extension of the susceptor in the final product. The susceptor sheet advantageously provides heat in a highly sufficient manner because the oblong or flat cross-section of the susceptor sheet yields an advantageous ratio between the susceptor volume and the heat releasing susceptor surface. In particular, heat may be provided over the entire diameter and along the entire length of the aerosol-forming rod.

In case the susceptor is provided as a continuous sheet, the continuous susceptor sheet may be supplied such as to enter the rod-forming process having a large or flat side of the continuous susceptor sheet arranged either substantially horizontally or substantially vertically.

Furthermore, in case the susceptor profile is a continuous sheet, the continuous susceptor sheet preferably is substantially orthogonal to the substrate web prior to gathering or partially gathering the substrate web. That is, a flat side of the susceptor sheet is substantially orthogonal to a flat side of the substrate web prior to gathering or partially gathering the substrate web. As used herein, the term 'flat side' refers to a surface of a sheet or a web that is normal to a thickness extension of the sheet or the web. This orientation of the susceptor sheet relative to the substrate web advantageously facilities gathering, in particular folding the continuous substrate web around the susceptor sheet. This particularly holds in case the substrate web is a single web to be gathered around the continuous susceptor sheet, that is, around a left and a right flat side of the susceptor sheet as seen in a downstream direction along the center axis of the rod-forming process. Preferably, when entering the rod-forming process, a flat side of the continuous susceptor sheet is arranged substantially vertically and a flat side of the substrate web—prior to being gathered or partially gathered—is arranged substantially horizontally, in particular below the continuous susceptor sheet.

As used herein, the terms 'substantially vertical', 'substantially horizontal' and 'substantially orthogonal' also include deviations of up to 20 degrees from a respective vertical, horizontal and orthogonal orientation.

Instead of a single substrate web, the substrate web may comprise a plurality of continuous sub-webs, in particular at least two separate continuous sub-webs to be gathered around the susceptor profile. In this case, the aerosol-forming substrate includes at least two separate continuous sub-webs. The two continuous sub-webs are supplied to the continuous rod-forming process such as to enter the rod-forming process laterally to the susceptor profile.

In case the susceptor is provided as a continuous sheet, the two continuous sub-webs are preferably supplied at opposite sides of the continuous susceptor sheet. In particular, a respective flat side of the continuous susceptor sheet faces a respective flat side of each of the two continuous sub-webs prior to gathering or partially gathering the sub-webs. That is, the susceptor sheet is substantially co-planar to the sub-webs prior to gathering or partially gathering the sub-webs. Advantageously, a symmetric supply of the substrate sub-webs around the susceptor sheet stabilizes the predefined position of the susceptor which in turn reduces the variability of the product performance. Preferably, the respective flat sides of the substrate sub-webs and the susceptor sheet are arranged substantially horizontally prior to gathering or partially gathering the sub-webs. Of course, the respective flat sides of the substrate sub-webs and the susceptor sheet may alternatively be arranged substantially vertically prior to gathering or partially gathering the sub-webs.

The at least two separate sub-webs may be a starting material of the method according the invention. In particular, the at least two separate sub-webs may be each provided on a separate bobbin. Where more than one bobbin is utilized the bobbins may contain the same aerosol-generating material. Alternatively, the bobbins may contain the aerosol-generating material may differ from each other, for example in one of composition, flavor, texture or combinations thereof.

Alternatively, the method according to the invention may comprise the steps of cutting and separating a single substrate web lengthwise into at least two, in particular two sub-webs prior to supplying the continuous sub-webs to the continuous rod-forming process.

According to a further aspect of the method, the method may comprise the step of supplying a wrapper to the rod-forming process and wrapping the wrapper around the substrate web. The wrapper may help to stabilize the shape of the aerosol-forming rod. It may also help to prevent an inadvertent disassociation of the substrate and the susceptor profile. For example, the wrapper may be a paper wrapper, in particular a paper wrapper made of cigarette paper. Alternatively, the wrapper may be a foil, for example made of metal, plastics or cellulose material. Preferably, the wrapper is fluid permeable or has been made, at least locally, fluid permeable such as to allow vaporized aerosol-forming substrate to be released from the article. The wrapper may be porous. Furthermore, the wrapper may comprise at least one volatile substance to be activated and released from the wrapper upon heating. For example, the wrapper may be impregnated with a flavoring volatile substance. Preferably, the step of supplying a wrapper to the rod-forming process and wrapping the wrapper around the substrate web is performed downstream of an upstream section or a first stage of the continuous rod-forming process.

Downstream the rod-forming process, the method provides a continuous inductively heatable aerosol-generating rod. Preferably, the continuous rod has a circular or oval or elliptical outer cross-section. However, the continuous rod may also have a rectangular or square or triangular or polygonal cross-section.

According to yet a further aspect of the method, the method comprises the step of cutting the continuous rod into inductively heatable rod segments. Preferably, the rod segments are of equal length. A length of the segments may be varied, depending on the consumable or inductively heatable smoking article to be manufactured using such an inductively heatable rod segment. Preferably, cutting is performed without reorientation of the continuous rod. Preferably, cutting is performed in a vertical direction. Preferably, the susceptor profile is positioned and oriented in the continuous rod such that no deformation of the susceptor occurs during cutting.

The aerosol-forming rods or rod segments may be used to form an inductively heatable aerosol-generating article. As used herein, the term 'aerosol-generating article' refers to an article comprising an aerosol-forming substrate to be used with an aerosol-generating device. The aerosol-generating article may be a consumable, in particular a consumable to be discarded after a single use. The aerosol-generating article may be a tobacco article. In particular, the article may be a rod-shaped article resembling conventional cigarettes. Apart from the aerosol-forming rod (rod segment), the aerosol-generating article may further comprise at least one of a support element, an aerosol-cooling element, a filter element and a mouthpiece element. Any one or any combination of these elements may be arranged sequentially to the aerosol-forming rod segment. These elements may have the same outer cross-section as the aerosol-forming rod segment. In particular, the aerosol-forming rod segment and any one or any combination of the above elements may be arranged sequentially and circumscribed by an outer wrapper to form a rod-shaped article.

According to the invention there is also provided an apparatus for manufacturing inductively heatable aerosol-forming rods. Preferably, the apparatus is configured for performing the method according to the invention and as described herein. The center axis of the rod-forming device preferably is a straight axis.

The apparatus according to the invention comprises a rod-forming device configured for gathering a substrate web comprising an aerosol-forming substrate into a rod shape around a continuous susceptor profile coaxially to a center axis of the rod-forming device. The rod-forming device is configured such that gathering of the substrate around the susceptor occurs as both, the substrate web and the susceptor profile, together pass through the rod-forming device.

The apparatus according to the invention further comprises a susceptor supply configured for supplying the susceptor profile to the rod-forming device such as to enter and pass the rod-forming device along the center axis of the rod-forming device. In particular, the susceptor supply is configured for supplying the susceptor profile to the rod-forming device such as to enter the rod-forming device at an upstream end of the rod-forming device long a center axis of the rod-forming device.

The apparatus further comprises a substrate supply configured for supplying the substrate web to the rod-forming device such as to enter the rod-forming device laterally to the susceptor profile.

For supplying the susceptor profile to the rod-forming device along the center axis of the rod-forming device, the apparatus preferably comprises a longitudinal guide. The longitudinal guide may be part of the susceptor supply. Preferably, at least a portion of the longitudinal guide is arranged upstream of the rod-forming device such as to pre-position the susceptor profile along the center-axis prior to entering the rod-forming device.

The longitudinal guide may comprise a guiding tube, for example a tube or a sleeve having both ends open. Alternatively, the longitudinal guide may comprise a rod-like trail having a longitudinal groove for guiding the susceptor profile in the groove.

Preferably, the longitudinal guide serves for guiding the susceptor profile along at least a section of the rod-forming device. Accordingly, the longitudinal guide may be configured for guiding the susceptor profile at least along 25 percent, in particular at least along 50 percent, preferably at least along 75 percent, more preferably at least along 90 percent or along 100 percent of a length of the rod-forming device. For this, the longitudinal guide may extend at least along 25 percent, in particular at least along 50 percent, preferably at least along 75 percent, more preferably at least along 90 percent or along 100 percent of a length of the rod-forming device. Preferably, the longitudinal guide serves for guiding the susceptor profile along at least an upstream section of the rod-forming device. For this, the longitudinal guide may extend downstream at least into an upstream section of the rod-forming device. Preferably, the longitudinal guide extends throughout the entire upstream section of the rod-forming device. Advantageously, a downstream end of the longitudinal guide is positioned at a downstream end of the upstream section of the rod-forming device or further downstream of the downstream end of the upstream section of the rod-forming device.

Preferably, an upstream end of the longitudinal guide is positioned upstream of an upstream end of the rod-forming device. This ensures the susceptor profile to be accurately pre-positioned at its desired final on-axis position within the aerosol-generating rod prior to entering the rod-forming device, that is, upstream of the rod-forming device.

The rod-forming device may comprise at least one funnel which is configured for gathering the substrate web in a transverse direction with respect to its longitudinal axis. A center axis of the funnel is coaxial to the center axis of the rod-forming device.

Preferably, it is a first stage of the rod-forming device or an upstream section of the rod-forming device which comprise a funnel. Accordingly, the longitudinal guide may extend downstream into the funnel of the first stage of the rod-forming device coaxially along a center axis of the funnel.

The first stage of the rod-forming device or the upstream section of the rod-forming device, in particular the funnel of the first stage or upstream section of the rod-forming device, preferably are configured such as to at least partially gather or even fully gather the substrate web around the susceptor profile but not yet into the final rod shape. In particular, upon passing the upstream section or the first stage of the rod-forming device, the substrate web may be a loose arrangement of at least partially gathered substrate. The at least partially gathered substrate may be of any form or shape, in particular of a rod shape, however with a lower density (or larger diameter) than in the final rod shape after having entirely passed the rod-forming process. Preferably, upon passing the upstream section or the first stage of the rod-forming device, the substrate web is gathered at least as much as to at least partially surround the susceptor profile. Advantageously, this may provide a supporting embedding of the susceptor by the substrate material for preserving the pre-defined position of the susceptor profile.

The rod-forming device may also comprises at least one semi-funnel. Preferably, it is a second stage of the rod-forming device or a downstream section of the rod-forming device which comprise a semi-funnel. The second stage of the rod-forming device or a downstream section of the rod-forming device is downstream of the first stage of the rod-forming device or downstream of the upstream section of the rod-forming device, respectively. The semi-funnel preferably comprises a rod-forming concave surface that remains open along a longitudinal axis of the funnel. The concave surface preferably has a C-shaped or U-shaped cross-section. For example, the semi-funnel is one half of a 'full' funnel.

The funnel and the semi-funnel may be configured such as to have an inner cross-section which progressively decreases downstream and thus causes the substrate web to be progressively gathered and compressed around the susceptor profile.

Advantageously, each of the funnel and the semi-funnel comprises a low friction surface material, for example, a plastic or polished metal surface, to get into contact with the substrate web. This reduces the risk of material weakening or even rupture of the substrate web. Furthermore, less friction also reduces vibrations of the substrate web as passing through the funnel and the semi-funnel, respectively.

The second stage or downstream section of the rod-forming device may further comprise a conveyor belt, typically called garniture tape, which preferably interacts with the at least one semi-funnel to form the final rod shape. For this, the garniture tape may progressively take a cross-sectional U-shape along the second stage or the downstream section. Preferably, the garniture tape is arranged below the center axis, whereas the at least one semi-funnel is arranged above the center axis and thus above the garniture tape.

In operation, the U-shaped garniture tape in combination with the semi-funnel gathers the substrate web coaxially around the susceptor profile into the final rod shape.

The garniture tape may further support a wrapper. The wrapper may be supplied by a wrapper supply into an upstream end of the second stage or into a downstream section of the rod-forming device. The wrapper supply may for example include a wrapper bobbin. Preferably, the wrapper is supported on a surface of the garniture tape which faces the center axis. Thus, in operation the wrapper is automatically wrapped around the substrate web as the latter is progressively gathered around the susceptor profile into the final rod shape. The wrapper supply may also add glue to at least a portion of the wrapper for keeping the wrapper around the substrate.

At its downstream end, the rod-forming device provides a continuous aerosol-forming rod having the final rod-shape in which the substrate web is fully gathered around the susceptor profile and preferably also entirely surround by a wrapper.

Downstream of the rod-forming device, the apparatus may further comprise a cutting device for cutting the continuous rod into inductively heatable aerosol-forming rod segments.

The apparatus may further comprise a strip cutter for cutting the substrate web lengthwise into a plurality of continuous sub-webs, in particular into two continuous sub-webs. The strip cutter is arranged upstream of the rod-forming device.

Further features and advantages of apparatus according to the invention have been described with regard to method and will not be repeated.

In principle, the method and the device according to the invention could also be used to place any element other than the susceptor profile into the aerosol-forming rod, for example, capsules, adsorbents, or a thread.

Figure 2:
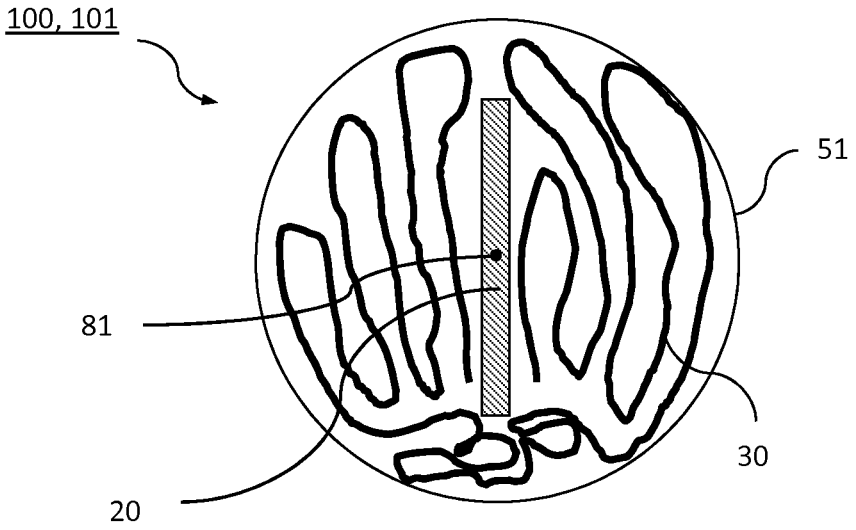
Figure 3:
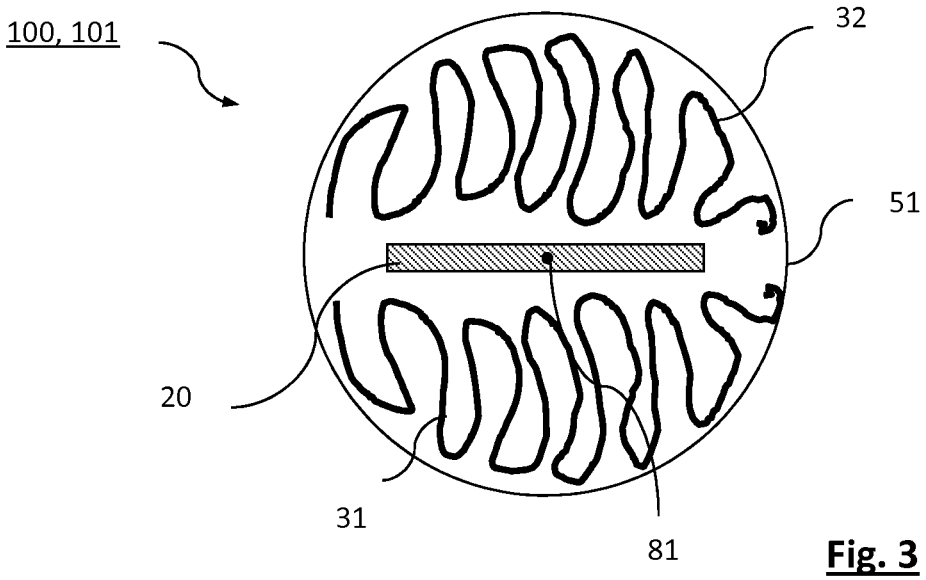

The invention will be further described, by way of example only, with reference to the accompanying drawings, in which:

FIG. 1 schematically illustrates an exemplary embodiment of an apparatus according to the invention;

FIG. 2 is a schematic cross-sectional view of a first embodiment of an aerosol-forming rod manufactured by using the method and the apparatus according to the invention; and FIG. 3 is a schematic cross-sectional view of a second embodiment of an aerosol-forming rod manufactured by using the method and the apparatus according to the invention.

FIG. 1 schematically illustrates an exemplary embodiment of an apparatus 1 according to the invention. The apparatus 1 is configured for manufacturing aerosol-forming rods 100 comprising a susceptor profile 20 in the center which a substrate web 30 including an aerosol-forming substrate is coaxially gathered around. The apparatus 1 as shown in FIG. 1 is particularly configured for performing the method according to the invention and as described herein.

Main component of the apparatus 1 is a rod-forming device 10 configured for gathering the substrate web 30 around the susceptor profile 20 coaxially to a center axis 80 of the rod-forming device 10, thus resulting in the final rod shape. The rod-forming process is a continuous process. That is, the substrate web 30 and the susceptor profile 20 enter and pass the rod-forming device 10 as continuous materials. Accordingly, gathering of the substrate web 30 around the susceptor profile 20 occurs as the substrate web 30 and the susceptor profile 20 together pass through the rod-forming device 10. The center axis 80 also defines a transport line through the rod-forming device 10.

Upstream of the rod-forming device 10, the apparatus 1 comprises a substrate supply 35 for supplying the substrate web 30 to the rod-forming device 10. In the present embodiment, the substrate web 30 is provided from below, for example, from a bobbin (symbolized by the arrow pointing upwards) and deflected towards the upstream end 13 (entrance) of the rod-forming device 10 by a horizontally oriented deflection roller 36. The substrate web 30 preferably is a continuous tobacco web, for example a cast leaf. The substrate web 30 enters the rod-forming device 10 as substantially flat material. In particular, the substrate web 30 is supplied such as to enter the rod-forming device 10 below the center axis 80. As can be seen from FIG. 1, the flat sides of the web 30 are arranged substantially horizontally when entering the rod-forming device 10.

The apparatus 1 further comprises a susceptor supply 21 for supplying the continuous susceptor profile 20 downstream towards the rod-forming device 10. In the present embodiment, the susceptor profile 20 is a continuous sheet 20 of a susceptor material having a rectangular cross-section, such as a continuous band made of ferromagnetic stainless steel. The susceptor profile 20 may be provided, for example, on a horizontally oriented bobbin, arranged laterally with regard to the transport line through the rod-forming device 10 (symbolized by the arrow pointing towards the center axis 80). The bobbin is part of the susceptor supply 21. The susceptor profile 20 is unwound from the bobbin and supplied from a side towards the center axis 80 upstream of the rod-forming device 10.

According to the invention it has been recognized that accurate positioning of the susceptor profile 20 within the cross-section of the aerosol-forming rod 100 is crucial for an adequate heating of the substrate and thus for an adequate aerosol formation. Hence, in order to ensure an accurate positioning, the susceptor profile 20 is supplied to the rod-forming device 10 such as to enter and pass the rod-forming device 10 along the center axis 80. Due to the central positioning, the susceptor profile 20 is accurately placed at its desired final position within the aerosol-generating rod, that is, coaxially to, in particular on-axis with a center axis of the aerosol-generating rod 100. To achieve the central positioning, the susceptor supply 21 according to the present embodiment comprises a vertically oriented deflection roller 22 which is arranged and configured such as to deflect the susceptor profile 20 towards to the center axis 80. Thus, the susceptor profile 20 is positioned along the center axis 80 having the flat sides of the susceptor profile 20 arranged substantially vertically. In particular, the susceptor profile 20 is positioned on-axis with regard to the center axis 80 of the rod-forming device 10. That is, a longitudinal axis of the susceptor profile 20 extending through a center of mass or a geometric center of the susceptor profile 20 is coaxial to the center axis 80 of the rod-forming device 10. In particular, the susceptor profile 20 is already pre-positioned on-axis upstream of the continuous rod-forming device and prior to getting into contact with the substrate web 30. Thus, the pre-positioned susceptor profile 20 defines a physical center for the rod-forming process which the substrate web 30 is coaxially gathered around. Advantageously, this causes the rod-forming process to be reliable and reproducible with regard to an accurate center position of the susceptor within the surrounding substrate.

As mentioned above, the substrate web 30 is supplied such as to enter the rod-forming device 10 below the center axis 80 of the rod-forming device 10. That is, the substrate web 30 enters the rod-forming device 10 laterally to the susceptor profile 20. In particular, the substrate web 30 enters the rod-forming device 10 alongside the susceptor profile 20 at an angle of zero degrees, that is, parallel to the center axis 80. Alternatively the substrate web 30 may enter the rod-forming device 10 from below towards the susceptor profile 20, that is, at an angle greater than zero degrees to the center axis 80, for example at an angle of 5 degrees. In that case, a width extension of the substrate web 30—prior to being gathered—preferably still extends horizontally though the substrate web 30 ascends upward at angle along its length extension.

In any case, having the substrate web 30 entering the rod-forming device 10 laterally to the susceptor profile 20 advantageously ensures that there is little or essentially no divergence of the susceptor profile 20 from its pre-defined on-axis position upon entering the rod-forming device 10. In particular, having the substrate web 30 arranged substantially horizontally below the susceptor profile 20 and the susceptor profile 20 arranged substantially vertically advantageously facilities gathering, in particular folding the substrate web 30 symmetrically around the left flat side and the right flat side of the susceptor profile 20. Furthermore, as the substrate web 30 is arranged below the susceptor profile 20 the substrate web 30 advantageously supports the susceptor profile 20 as both pass through the rod-forming device 10. This also facilitates to keep a stable position of the susceptor profile 20 along the center axis 80.

In the present embodiment, the rod-forming device 10 comprises two stages, a first stage 11 defining an upstream section of the device 10, and a second stage 12 defining a downstream section of the device 10. The first stage 11 comprises a frustum-shaped funnel 71 arranged coaxially to the center axis 80. A circular inner cross-sectional profile of the funnel 71 continuously decreases from an upstream end 13 towards a downstream end 14 of the funnel 71. The funnel 71 gathers the substrate web 30 in a transverse direction with respect to a transport direction of the substrate web 30 or a length extension of the substrate web 30, respectively. Upon having passed the first stage 11, the substrate web 30 is partially gathered but has not yet assumed the final rod shape.

In order to prevent the susceptor profile 20 from being displaced from the center axis 80 as passing through the rod-forming device 10, the apparatus 1 further comprises a longitudinal guide 23 for guiding the susceptor profile 20 along the center axis 80. In the present embodiment, the longitudinal guide is a guiding tube 23 extending coaxially to the center axis 80 through the entire funnel 71.

The guiding tube 23 also extends in the upstream direction beyond an upstream end 13 of the funnel 71. That is, an upstream end 24 of the guiding tube 23 is positioned upstream of the funnel 71. Advantageously, this supports an accurate pre-positioning and guiding of the susceptor profile 20 along the center axis 80 prior to entering the rod-forming device 10.

Advantageously, the guiding tube 23 ends at a downstream position where the susceptor profile 20 preferably is at least partially surrounded and thus supported by the partially gathered substrate web 30. In the present embodiment, a downstream end 25 of the guiding tube 23 is positioned adjacent to an upstream end 15 of the second stage 12.

The second stage 12 of the rod-forming device is configured for completing the step of gathering the substrate web 30 coaxially around the susceptor profile 20 into the final rod shape. In the present embodiment, the second stage 12 comprises a semi-funnel 72 arranged above the center axis 80 which comprises a rod-forming concave surface having a C-shaped cross-section. The C-shaped cross-section progressively decreases in size downstream from the upstream end 15 to a downstream end 16 of the second stage 12. The second stage 12 further comprises a conveyor belt 17, in the present embodiment a garniture tape 17, which interacts with the semi-funnel 72 to form the final rod shape. For this, the garniture tape 17 progressively takes a cross-sectional U-shape as it runs along the second stage 12 downstream below the center axis 80. In operation, the U-shaped garniture tape 17 in combination with the semi-funnel 72 gathers the partially pre-gathered substrate web 30 coaxially around the susceptor profile 20 into the final circular rod shape.

In addition, a paper wrapper 51 is supplied from a wrapper supply 50 into the upstream end 15 of the second stage 12. As can be seen from FIG. 1, the wrapper 51 is supported on a top surface of the garniture tape 17 which faces the center axis 80. Thus, in operation the wrapper 51 is automatically wrapped around the substrate web 30 as the latter is progressively gathered around the susceptor profile 20. Preferably, glue is added to at least one longitudinal edge of the wrapper 51 for connecting both longitudinal edges of the wrapper upon being wrapped around the rod-shaped material of the substrate web 30. Thus, the wrapper 51 serves to stabilize the final rod shape. For adding glue and connecting the longitudinal edges of the wrapper 51, the rod-forming device 10 according to the present embodiment comprises a folding and compressing device 18 downstream of the second stage 12.

At a downstream end 19 of the overall rod-forming device 10, the device 10 provides a continuous aerosol-forming rod 100 having the final rod-shape in which the substrate web 30 is fully gathered around the susceptor profile 20 and entirely surround by the wrapper 51.

Downstream of the rod-forming device 10, the apparatus 1 further comprises a cutting device 60 for cutting the continuous rod 100 into inductively heatable aerosol-forming rod segments 101.

FIG. 2 shows a cross-sectional view of a continuous aerosol-forming rod 100 or rod segment 101, respectively, manufactured using the apparatus and the method as illustrated in FIG. 1 and described before. The circular cross-section of the rod shape may have a diameter between about 4 millimeters and about 10 millimeters, in particular, between about 5 millimeters and about 8 millimeters. The rectangular shape of the susceptor profile 20 preferably has a width extension between about 2 millimeters and about 8 millimeters, in particular between about 3 millimeters and about 5 millimeters, and a thickness extension between about 0.03 millimeter and about 0.15 millimeter, more preferably between about 0.05 millimeter and about 0.09 millimeter. As can be seen from FIG. 2, the susceptor profile 20 is positioned substantially symmetrically with regard to a center 81 of the circular cross-section of the rod-shape. This position is preferred with regard to a homogeneous, in particular symmetric and reproducible heat distribution in the aerosol-generating rod. Thus, heat generated in the susceptor profile 20 symmetrically dissipates into the circumferential periphery of the susceptor profile 20 allowing to homogeneously heat-up the aerosol-forming substrate of the substrate web 30 gathered around. As can be further seen from FIG. 2, the substrate web 30 is substantially symmetrically gathered from below around a left and a right flat side of the susceptor profile 20. This is due to supplying the susceptor profile 20 substantially vertically along the center axis 80 and the substrate web 30—as a single web—substantially horizontally below the center axis 80.

With reference to FIG. 3, a modification of the method according to the invention is described hereafter. Instead of supplying the substrate web 30 as a single web, the substrate web 30 may be alternatively supplied as two sub-webs 31, 32. The two sub-webs 31, 32 may be a starting material of the overall process. For example, each sub-web 31, 32 may be provided on a separate bobbin. Alternatively, a single substrate web may be a starting material which is divided into two sub-webs 31, 32 upstream of the rod-forming device. In both cases, the two sub-webs 31, 32 preferably are supplied separately to the rod-forming device. In particular, the two sub-webs 31, 32 are supplied to the rod-forming device such as to enter the device laterally to the susceptor profile 20 at opposite sides of the susceptor profile. That is, the susceptor profile 20 is sandwiched between the two sub-webs 31, 32.

In case of a flat susceptor profile 20, the two sub-webs 31, 32 and the susceptor profile 20 are preferably supplied to the rod-forming device such that the susceptor profile is substantially co-planar to the sub-webs 31, 32 prior to gathering the sub-webs 31, 32 around the susceptor profile 20. Advantageously, this facilitates to ensure that the substrate material is substantially symmetrically gathered around both flat sides of the susceptors sheet 20.

Even more preferably, the two sub-webs 31, 32 and the susceptor profile 20 are supplied to the rod-forming device in a substantially horizontal arrangement. Advantageously, this enables the lower sub-web 31 to support the susceptor profile 20 which in turn proves advantageous for keeping a stable position of the susceptor profile 20 along the center axis 80. FIG. 3 shows a cross-sectional view of an aerosol-forming rod 100 or rod segment 101, respectively, which has been manufactured accordingly.

The invention claimed is:

1. Method for manufacturing inductively heatable aerosol-forming rods, the method comprising the steps of:

supplying a continuous susceptor profile to a continuous rod-forming process such as to enter and pass the rod-forming process along a center axis of the rod-forming process;

supplying a substrate web comprising an aerosol-forming substrate to the continuous rod-forming process such as to enter the rod-forming process laterally to the susceptor profile;

passing the substrate web and the susceptor profile through the rod-forming process, thereby gathering the substrate web into a rod shape around the susceptor profile substantially coaxially to the center axis.

2. The method according to claim 1, wherein the susceptor profile is dimensionally stable.

3. The method according to claim 1, wherein the step of passing the susceptor profile through the rod-forming process comprises longitudinally guiding the susceptor profile at least along an upstream section of the rod-forming process.

4. The method according to claim 1, further comprising the step of partially gathering the substrate in a transverse direction with respect to a transport direction of the substrate web prior to gathering the substrate web into a rod shape around the susceptor profile.

5. The method according to claim 4, wherein the susceptor profile is a susceptor sheet, and wherein the susceptor sheet is substantially orthogonal to the substrate web prior to partially gathering the substrate web.

6. The method according to claim 4, wherein the substrate web includes at least two separate sub-webs, wherein the two sub-webs are supplied to the rod-forming process such as to enter the rod-forming process laterally to the susceptor profile at opposite sides of the susceptor profile.

7. The method according to claim 6, wherein the susceptor profile is a susceptor sheet, and wherein the susceptor sheet is substantially co-planar to the sub-webs prior to partially gathering the sub-webs.

8. The method according to claim 1, further comprising the step of supplying a wrapper to the rod-forming process and wrapping the wrapper around the substrate web.

9. The method according to claim 1, wherein the susceptor profile is a susceptor sheet, and wherein the susceptor sheet is substantially orthogonal to the substrate web prior to gathering the substrate web.

10. The method according to claim 1, wherein the substrate web includes at least two separate sub-webs, wherein the two sub-webs are supplied to the rod-forming process such as to enter the rod-forming process laterally to the susceptor profile at opposite sides of the susceptor profile.

11. The method according to claim 10, further comprising the steps of cutting and separating the substrate web lengthwise into the two sub-webs of the aerosol-forming substrate prior to supplying the two continuous sub-webs to the rod-forming process.

12. The method according to claim 10, wherein the susceptor profile is a susceptor sheet, and wherein the susceptor sheet is substantially co-planar to the sub-webs prior to gathering the sub-webs.

13. Apparatus for manufacturing inductively heatable aerosol-forming rods, the apparatus comprising:

a rod-forming device configured for gathering a continuous substrate web comprising an aerosol-forming substrate into a rod shape around a continuous susceptor profile coaxially to a center axis of the rod-forming device as the substrate web and the susceptor profile pass through the rod-forming device;

a susceptor supply configured for supplying the susceptor profile to the rod-forming device such as to enter and pass the rod-forming device along the center axis of the rod-forming device;

a substrate supply configured for supplying the substrate web to the rod-forming device such as to enter the rod-forming device laterally to the susceptor profile.

14. The apparatus according to claim 13, wherein further comprising a longitudinal guide for guiding the susceptor profile along the center axis.

15. The apparatus according to claim 14, wherein the longitudinal guide extends downstream at least into an upstream section of the rod-forming device.

16. The apparatus according to claim 14, wherein an upstream end of the longitudinal guide is positioned upstream of an upstream end of the rod-forming device.

17. The apparatus according to claim 14, wherein the longitudinal guide comprises a guiding tube.

18. The apparatus according to claim 13, wherein the rod-forming device comprises at least one funnel coaxial to the center axis.

* * * * *